United States Patent [19]

Mackintosh

[11] Patent Number: 4,640,469

[45] Date of Patent: Feb. 3, 1987

[54] SYSTEM FOR ROLLING AND UNROLLING A GROUND COVER

[76] Inventor: Charles Mackintosh, 3838 Oakwood Ave., Los Angeles, Calif. 90004

[21] Appl. No.: 766,425

[22] Filed: Aug. 15, 1985

Related U.S. Application Data

[63] Continuation-in-part of Ser. No. 656,330, Oct. 1, 1984, abandoned.

[51] Int. Cl.[4] ..... B65H 16/00; B65H 18/10

[52] U.S. Cl. ..... 242/55; 242/67.1 R

[58] Field of Search ..... 242/55, 67.1, 68.7, 242/86.5 R, 86.52; 273/27

[56] References Cited

U.S. PATENT DOCUMENTS

| | | | |
|---|---|---|---|
| 1,966,687 | 7/1934 | Scott | 273/27 |
| 3,099,444 | 7/1963 | Burt | 273/27 |
| 3,782,663 | 1/1974 | Stevenson | 242/55 |
| 4,399,954 | 8/1983 | Arrant | 242/86.52 |

FOREIGN PATENT DOCUMENTS

| | | | |
|---|---|---|---|
| 2495482 | 6/1982 | France | 273/27 |

*Primary Examiner*—John M. Jillions

*Attorney, Agent, or Firm*—Watson, Cole, Grindle & Watson

[57] ABSTRACT

A system for tightly rolling and unrolling a web employed as a ground cover includes the use of unrolling tapes for unrolling the web, and an unpowered gear motor which serves to retard unrolling, rollup tapes and/or the gear motor being employed for rolling up the web together with an elongated flexible and unstretchable tube partially filled with fluid which supports the web and causes it to slip on itself for tightening any web bulges while being rolled up.

10 Claims, 12 Drawing Figures

SYSTEM FOR ROLLING AND UNROLLING A GROUND COVER

RELATED APPLICATION

This application is a continuation-in-part of U.S. Pat. application Ser. No. 656,330 filed Oct. 1, 1984 now abandoned.

BACKGROUND OF THE INVENTION

This invention relates generally to a system for rolling and unrolling a web for uncovering and covering a surface on which the web rests. More particularly, the web is in the form of a large, one-piece storable artificial material suitable for covering a playing field, but which may be removed when necessary.

Large sized artifical materials are utilized as surface coverings for base surfaces such as playing surfaces for football and baseball and other applications, and require apparatus for handling such material in laying it down and rolling it up on a spindle or core. Normally, carriers are provided for laying and removing the cover, with or without a vehicle, such that the carriers support the bulky and extremely heavy rolled material as they traverse the playing field during coering and uncovering. It can be seen that the cost of providing and powering the necessary equipment to carry out the rolling and unrolling operations for artificial turf material, can be extremely high, and the operations time-consuming and labor intensive.

Moreover, prior techniques employed in rolling and unrolling such a cover are beset with problems in bulging of the web during web rolling and unrolling which increases the likelihood of web damage due to pinching or creasing and results in uneven covering of the playing field.

SUMMARY OF THE INVENTION

It is therefore an object of the present invention to provide a system for rolling and unrolling the web of material directly across the surface to be covered without the need for carrier apparatus of any type, and in a manner whereby the web is tightly rolled and unrolled to reduce the likelihood of bulging and to assure that the web is flatly and evenly laid on its surface.

The system according to the invention for tightly rolling up the web includes either a gear motor coupled to the core about which the web is rolled for rolling it up, or a plurality of spaced straps wrapped about the outer periphery of the roll in the same direction of roll-up. Or, both the gear motor and the straps may be used together in rolling up the web. Means are provided for tightening the roll turns about one another during roll-up, such means comprising a closed-ended tube of flexible and unstretchable material partially filled with a fluid. The tube has a length substantially the same as the web width and underlies the roll for supporting it above the web which covers the surface. The tube lies initially beneath the roll such that its central axis is spaced from the central axis of the roll in the direction of roll-up, the tube normally lying beneath the roll such that the central axes lie in a common plane perpendicular to the web covering surface. In such manner, the tube shifts during web roll-up by rolling on itself from its initial to its normal position for causing the roll to slip to thereby tighten the web, whereafter the tube rolls on itself and moves in the same direction parallel to the web core so as to maintain a tight web.

The web unrolling system of the invention includes a plurality of leather straps disposed between individual turns of the wound web in the same direction of web winding such that an unwinding of the straps effects an unrolling of the web. The gear motor operatively coupled with the core is unpowered and unlocked so as to retard rotation of the core against unrolling to thereby effect a tightening of the web during unrolling.

A further feature of the invention includes the provision of guide arms journaled at both ends of the core and engaging grooves in the surface to be covered for guiding the web roll therealong during rolling and unrolling.

Other objects, advantages, and novel features of the invention will become more apparent from the following detailed description of the invention when taken in conjunction with the accompanying drawings.

DETAILED DESCRIPTION OF THE INVENTION

Figure 1:
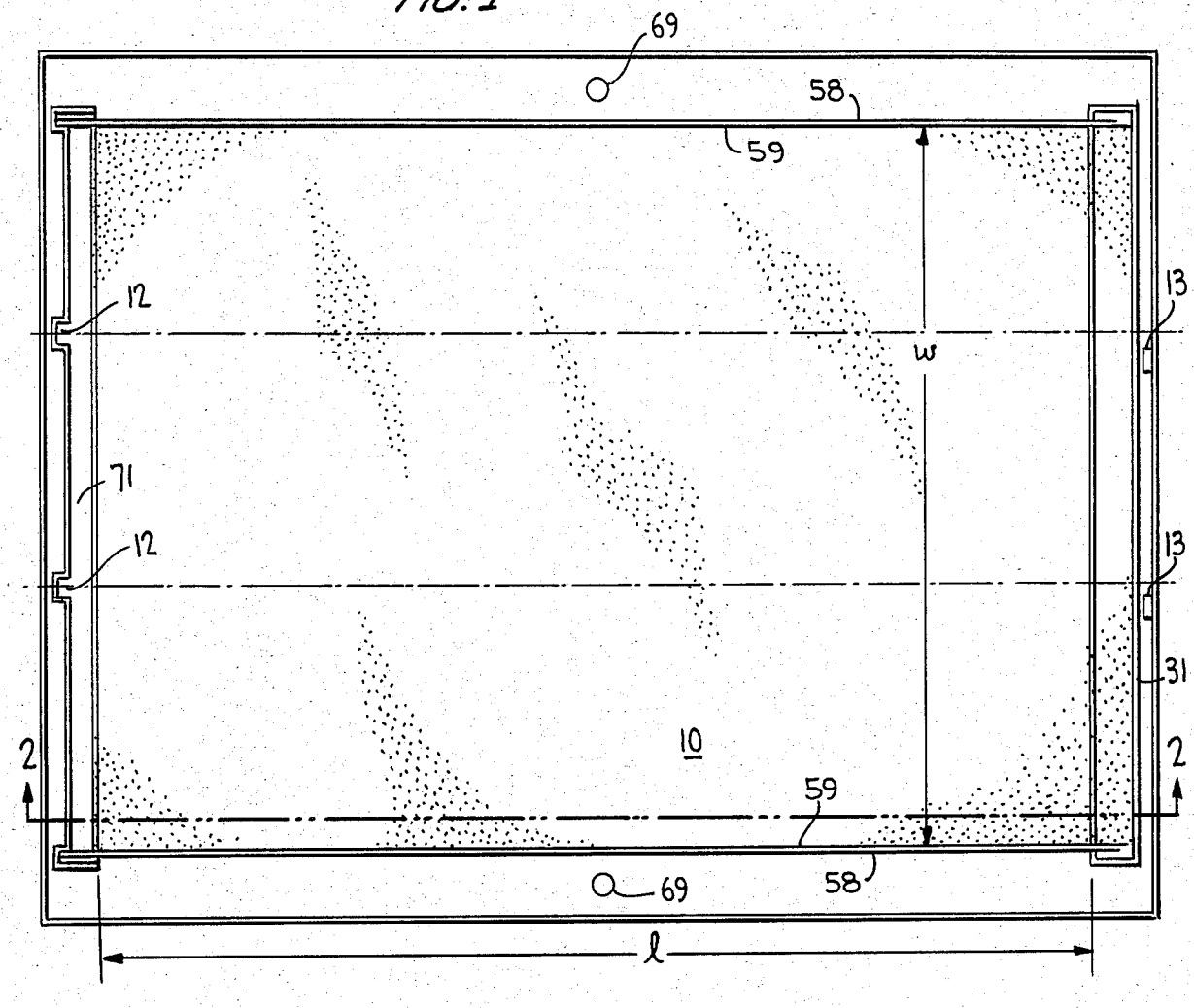
FIG. 1 is schematic illustration in plan view of a playing field to be covered and uncovered in accordance with the invention.
Figure 2:
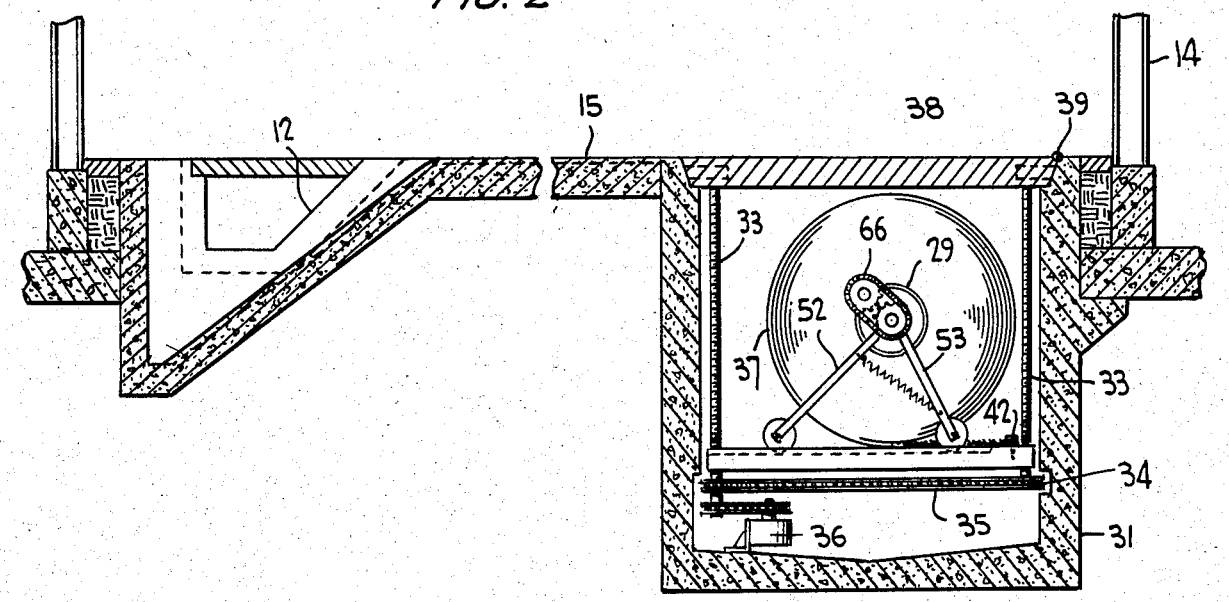
FIG. 2 is a sectional view of the playing field of FIG. 1, taken substantially along the line 2—2 thereof, showing the fully rolled up web located in a storage pit.
Figure 4:
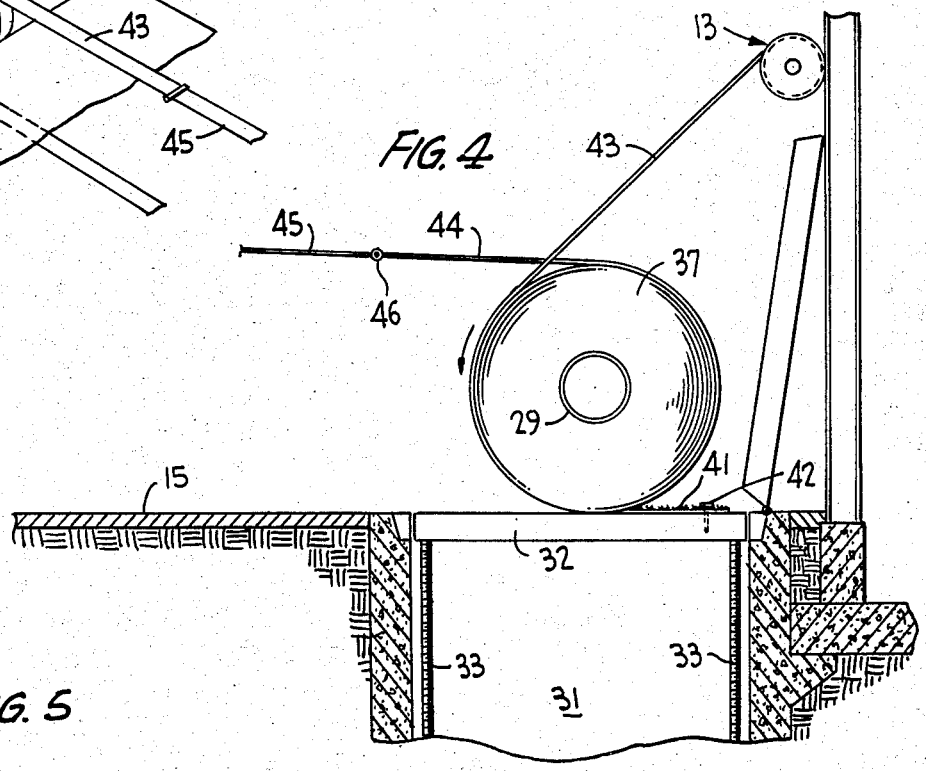
FIG. 4 is a view similar to FIG. 2 showing the full roll raised out of its pit prior to unrolling.
Figure 5:
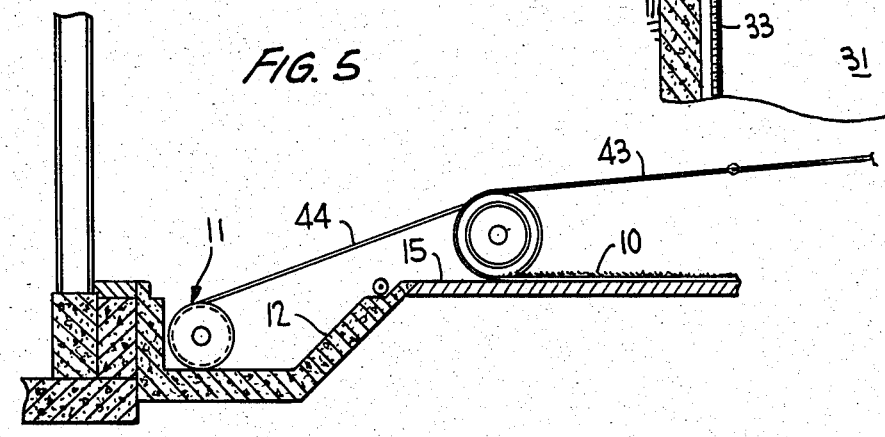
FIG. 5 is a view similar to FIG. 3 showing the web in the process of being unrolled over the playing surface.

Turning now to the drawings wherein like reference characters refer to like and corresponding parts throughout the several views, a playing field, e.g. a football field, is schematically illustrated in FIG. 1 with its surface covered by a web 10 of artificial turf material substantially throughout the length 1 and width w thereof in a lengthwise direction of the field employing the system according to the invention. A pair of winch assemblies generally designated 11 are mounted in their respective pits 12 located at one end of the playing field for unrolling the web. And, corresponding winches generally designated 13 are located at the opposite end of the field mounted on a wall 14 (FIG. 4). Playing surface 15 to be covered is typically a hard surface such as concrete shown in FIG. 2 although, of course, may be of any other suitable hard surfaces such as asphalt.

Figure 6:
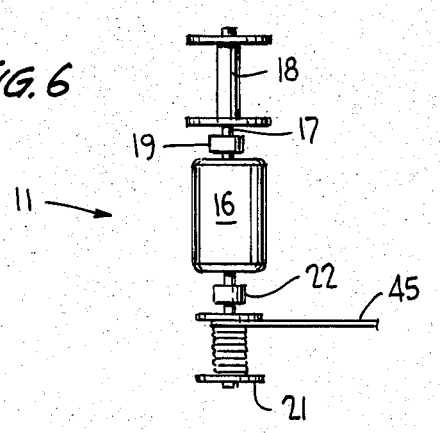
FIGS. 6 and 7 are plan views of unrolling and rolling winch assemblies, respectively.

Each of the winch assemblies 11, shown in FIG. 6, includes a drive motor 16, which may comprise a gear motor or the like, having an output shaft 17 supporting a rotatably mounted strap storage reel 18 for rotation through a suitable clutch 19 of any known type. The output drive shaft of the motor likewise supports a cable reel 21 for rotation through a suitable clutch 22.

At the other end of the field, each winch assembly 13 (FIG. 7) includes a cable reel 23 mounted on a shaft 24, and a strap storage reel 25 likewise mounted on the shaft, the reels being engaged and disengaged from the shaft for rotation therewith via a clutch 26. And, an idler pulley 27 is suitably mounted for rotation coaxial with reels 23 and 25. A right angle gear drive 28 is operatively connected with shaft 24, and is driven by a removable handle (not shown).

Referring to FIGS. 4 to 7, a web of artificial turf material 10, having a width approximately equal to width w of the playing surface to be covered, is illustrated in a rolled up condition on a drum or core 29 (FIG. 4). The fully rolled up web is initially stored in an elongated pit 31 on an elevator platform 32. The platform has internally threaded openings at its four corners in threaded engagement with externally threaded elevator rods 33. Sprockets 34 are mounted on the rods beneath the platform, and a continuous sprocket chain 35 is trained about all four sprockets. A drive motor 36 is operatively coupled with one of the elevator rods for rotation which causes all the rods to rotate simultaneously in the same direction to thereby elevate platform 32. As the platform is elevated, the web roll 37 bears against the underside of a hatch cover 38 hinged at 39 to pit 31 for opening the hatch cover from its FIG. 2 to its FIG. 4 positions resting against wall 14. The top of the elevator platform is now coplanar with playing surface 15.

An end 41 of web 10 is anchored as at 42 to the elevator platform, and the web roll may be cradled within a shallow trough (not shown) provided in the surface of platform 32 for stablizing the roll against inadvertant movement at its storage position.

Figure 8:
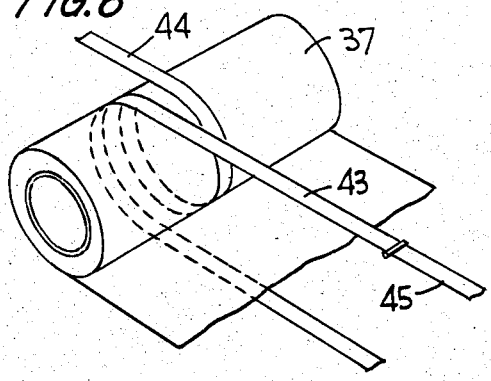
FIG. 8 is a perspective view if a portion of the web roll showing the rolling and unrolling straps.
Figure 7:
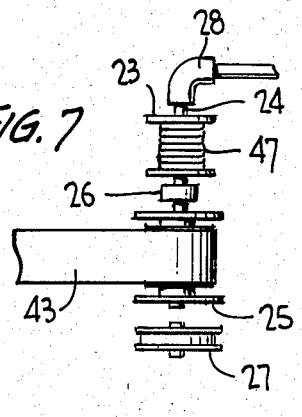

Straps are employed for unrolling the web roll from its fully rolled up position and for rolling it back up. A fabric strap 43 of each winch assembly 13, is shown in FIG. 7 as reeled on its storage reel 25 and wrapped about the outer periphery of the rolled up web (FIGS. 4 and 8). Each strap 43 underlies the web roll and is tacked at its free end beneath free end 41 of the web. And, a strap 44 lies between individual turns of the wound web roll after having been rolled up together therewith in the same direction of winding as will become more apparent hereinafter when describing the web rolling operation. Strap 44, associated with each of the winch assemblies 11, is clearly illustrated in FIG. 8.

A cable 45 is reeled up on its storage reel 21 (FIG. 6), and has a hooked free end. When the rolled web is to be unrolled from its FIG. 4 position across the length of the playing surface, clutch 22 is disengaged, and the free end of cable 45 is carried across the length of the field unrolling from its free wheeling cable reel 21. The cable is attached to the free end of fabric strap 44 as at 46. Clutch 22 is then engaged while clutch 26 is disengaged to permit free wheeling of strap reel 25. Motor 16 is then operated for driving reel 21 which reels up cable 45 to thereby unwind strap 43 causing the web roll to rotate in the direction of the curved arrow of FIG. 4, and to move toward the center of the field. As the web unrolls by pulling on each strap 43, the web is tensioned as it is laid across surface 15 and the weight of the web roll, as it continually moves along the layed web, squeezes out any air pockets which could otherwise occur during the laying operation. Moreover, as the web unrolls, strap 43 continues to surround the web roll as it decreases in diameter and underlies the laid web while the strap is unreeled from its free wheeling reel 25.

As the web is unrolled to mid-field, strap 43, which has a length substantially equal to length 1 of the surface to be covered, has fully unrolled from its strap reel 25, so that its trailing end simply falls onto the upper surface of the web with nearly half its length now lying on top of the unrolled web. Strap 43 is releasably attached in any normal manner to its reel 25 to facilitate release without resistance. And, the free end of strap 44, at the mid-field position, has traveled the full length of the field. Strap 44 is then detached from the end of cable 45, cable 45 is stored on its reel 21, and the full end of strap 44 is attached to strap reel 18 in any normal manner.

To continue the web unrolling operation, clutch 22 is disengaged and clutch 19 is engaged. The motor is operated for driving reel 18 so as to reel in strap 44 which facilitates a continued unrolling of the web, shown in the process of unrolling in FIG. 5 to its fully unrolled position of FIG. 3. As the web is being unrolled, strap 43 continues to be laid under the web by the progressively unrolling web roll. At the fully unrolled position, strap 44 will be fully rolled up on its storage reel 18, and strap 43 will be fully unrolled under the web.

For rolling the web back onto its drum or core 29 to uncover the playing surface, clutches 19 and 22 are disengaged. The free end of cable 45 is then carried across the field from its free wheeling reel 21, looped around free running sheave 27 and carried back across the field and attached to the free end of strap 43. Clutch 22 is then reengaged.

Motor 16 is then operated for driving reel 21 which reels in cable 45 so as to pull the connected end of strap 43 in a direction toward the other end of the field. The reel is therefore caused to roll up on its drum 50, while strap 44 rolls up together with the web between individual web turns as strap 45 unreels from its free wheeling reel 18. At mid-field, the free end of strap 43 will have reached winch assembly 13. And, since the length of strap 44 is substantially equal to length 1 of the playing surface to be covered, and being releasably attached to its reel 18 in some suitable manner, it will release therefrom at the mid-field position and simply fall onto surface 15, while the remaining one-half length of this strap has been rolled up with the web as aforedescribed. At such mid-field position, cable 45 is removed from sheave 27 and is disconnected from strap 43, and strap 43 is releasably connected to its strap reel 25. Cable 45 is then connected to the free end of a cable 47 stored on its storage roll 23, and clutch 26 is engaged to couple reels 23 and 25 together for rotation with common shaft 24.

Motor 16 is then operated to complete the rolling operation as cable 45 is reeled in and pulls the end of cable 47 to travel the full length of the field. During this process, strap 43 is reeled up on its reel 25. Cable 45 is then disconnected from cable 47, and clutch 26 is disengaged. The removable hand crank may then be utilized to reel cable 47 back onto its cable reel 23.

Figure 11:
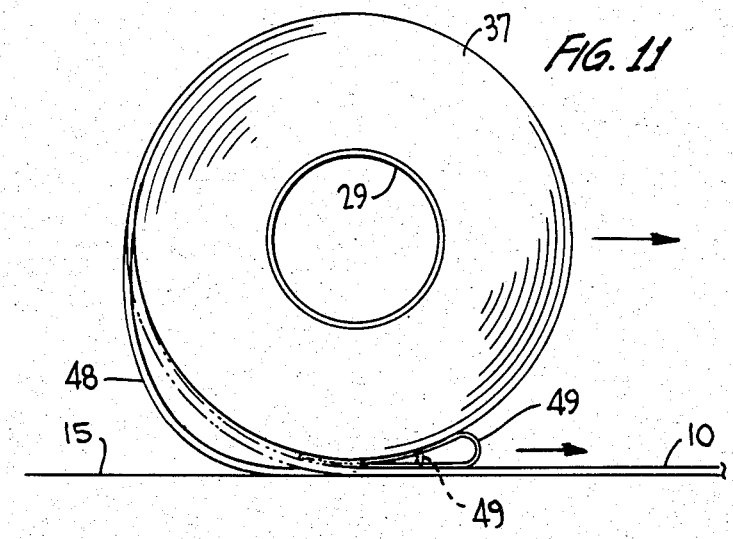
FIG. 11 is an enlarged side view of the web roll in the process of being rolled up.

During a rolling up of the web roll, the outermost turn of the web may bulge so as to form a loop 48 (FIG. 11) which, if not tightened, could cause the web to crease or wrinkle during roll up which could not only damage the web but would manifestly persist during an unrolling of the web thereby causing an uneven web surface. According to the present invention, a means for tightening the web turns during roll up is provided in the form of an elongated tube 49 of flexible and unstretchable material, such as a fabric, partially filled with a fluid, such as air. The tube has a length substantially of the same as the entire width of the web, and underlies the roll for supporting the roll above web 10 which overlies surface 15. As shown in solid outline in FIG. 11, the tube lies in an initial position beneath the roll such that the central axis of the tube is spaced in the direction of roll movement (roll arrow) from the central axis of the roll. And, the tube shifts from this initial position to its phantom outline position in which its central axis lies in the same plane as the central axis of the tube which plane is perpendicular to surface 15 and web 10 which covers it. In such manner, during a rolling up of the web, the tube shifts by simply rolling on itself from its solid outline to its phantom outline positions for causing the roll to slip as it rotates about its central axis without moving in its forward direction. Loop 48 is thus taken up and tightened against the roll as shown in phantom outline in FIG. 11, whereafter the tube moves together with the roll in the direction of the arrows shown in FIG. 11 during the continued roll up operation.

Figure 12:
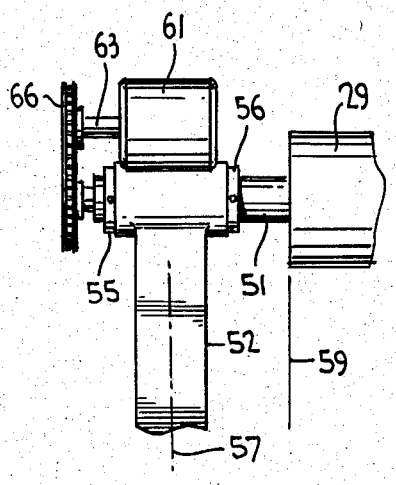
FIG. 12 is a top view of the gear motor operatively coupled to the web core, taken substantial along the line 12—12 of FIG. 9.

Web core 29 includes an axle 51 extending outwardly of opposite ends thereof (only one shown in FIG. 12), and pairs of guide arms 52, 53 being journaled to the axle at both ends of the core, the inner ends of the guide arms being mounted on a sleeve 54 on the axle, collars 55, 56, or the like on opposite ends of the sleeve being fixed to the axle for locating the sleeve thereon at an appropriate distance from the core such that centerline 57 of the guide arm pair coincides with the centerline of a guide track 58 (FIG. 10), while an edge 59 at the outer face of the core coincides with the edge of the artificial material. A gear motor 61 is mounted on sleeve 54 by means of a clamp 62 (FIG. 9), output shaft 63 of the motor having a drive sprocket 64 thereon, and axle 51 having a sprocket 65 thereon. Sprockets 64, 65 are slightly spaced apart out of meshing engagement, and an endless drive chain 66 surrounds both sprockets.

Figure 9:
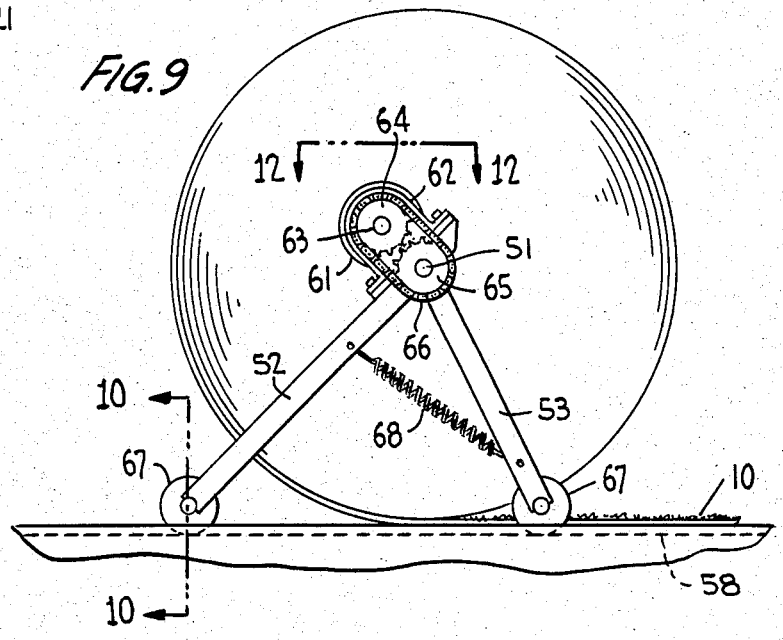
FIG. 9 is a side elevational view, at an enlarged scale, of the full roll after having been raised out of its pit.
Figure 10:
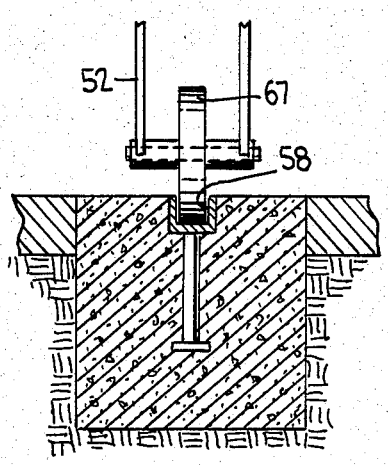
FIG. 10 is a view taken substantially along the line 10-10 of FIG. 9.

The outer ends of arms 52, 53 have idler rollers 67 thereon for rolling along track 58 (FIGS. 9 and 10). And, a coil spring 68 interconnects arms 52, 53 for resiliently biasing the arms together and insuring that the rollers are maintained within the guide track as the included angle between the arms changes as the web roll diameter changes during the web rolling and unrolling operations.

The aforedescribed drive motor and guide arms are located at both ends of the web core, and the motors are powered via power supplies 69 at opposite sides of the field shown schematically in FIG. 1.

Figure 3:
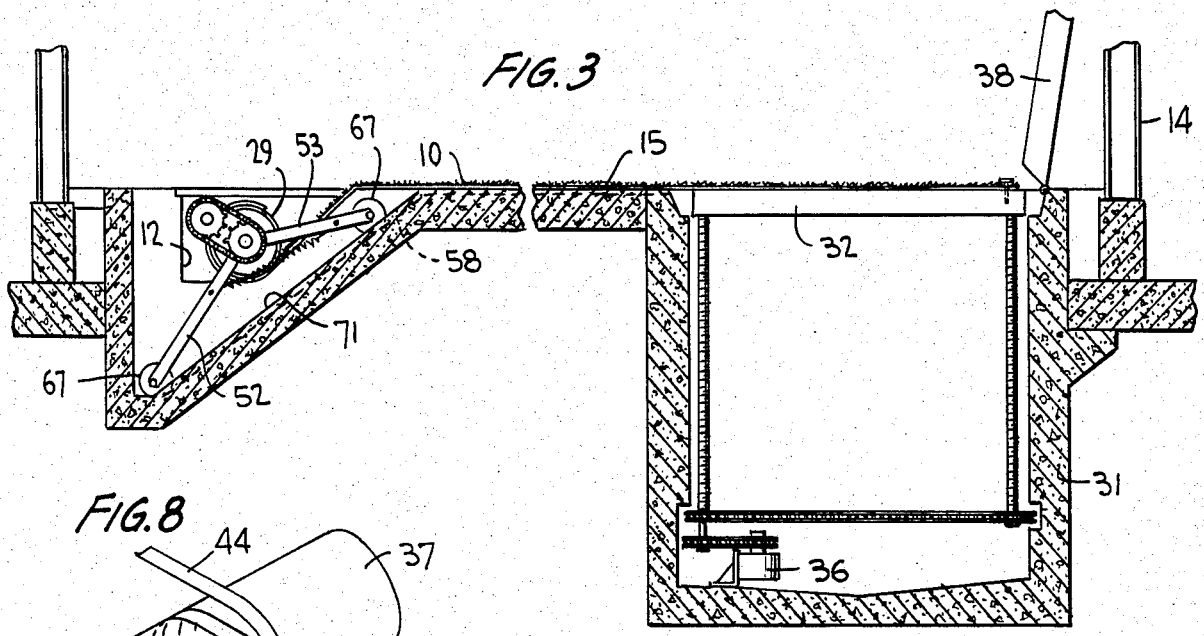
FIG. 3 is a view similar to FIG. 2 showing the web fully unrolled over the playing surface, with the empty roll stored in a storage pit at the other end of the field.

A pit 71 extends along the width of the field opposite pit 31, pit 71 being deeper and wider than each pit 12 but being in open communication therewith. And, tracks 58 continue along opposite ends of the pit 71. Thus, when the web is fully unrolled as shown in FIG. 3, the web roll diameter is at its minimum, and the included angle between guide arms 52, 53 is at its maximum with the coil spring therebetween fully stretched as rollers 67 continue to roll along guide track 58.

During the unrolling operation from the fully rolled up position of FIG. 4, winch assemblies 11 are operated for reeling in straps 44 as in the manner aforedescribed. However, in order to continually tighten the web turns about one another during web unrolling so as to assure an even carpet lay down without bulging or creasing, the power from power supplies 69 is turned off such that motors 61 at opposite ends of the web core are turned off but are unlocked. Thus, the gear rotation of the motors coupled with the rotating web core via sprockets 64, 65, acts as a brake so as to retard rotation of the web core (counterclockwise as shown in FIG. 9), such that the web turns are tightened about one another during unrolling. And, the guide arms at opposite ends of the web core accurately guide the web along tracks 58 and maintain edges 59 of the web spaced from the guide track. When the web is fully unrolled as shown in FIG. 3, the web core and its guide arm pairs 52, 53 at opposite ends are lowered into pit 71 which may be subsequently covered with a hatch (not shown) during field play.

When the web is being rolled up, each winch assembly 13 is activated for reeling in strap 43 as in the manner aforedescribed. In addition to the use of these roll-up straps 43, or in lieu thereof, motors 61 are activated as their supplies 69 are turned on rotating the core in a clockwise direction (viewed in FIGS. 9, 11). At some convenient stage during the process of rolling up the web, tube 49 is disposed beneath the roll in its initial position shown in FIG. 11 for allowing the roll to slip to thereby tighten the outer roll turn to take up any bulging such as 48 shown in this Figure. The bag then shifts to its position shown in phantom outline, and progresses in the direction of the arrows shown in FIG. 11 together with the core during rolling up.

Obviously, many modifications and variations of the present invention are made possible in the light of the above teachings. It it therefore to be understood within the scope of the appended claims the invention may be practiced otherwise than as specifically described.

What is claimed is:

1. A system for tightly rolling up a web covering a surface with one end of the web anchored to said surface, comprising a core about which the web is rolled, means for rolling up the web into a roll about said core from the other end thereof in the direction of said one end, and means for tightening the roll turns about one another during roll-up, said tightening means comprising a closed-ended tube of flexible and unstretchable material partially filled with a fluid, said tube having a length substantially equal to the width of said web, said tube underlying the roll for supporting the same above the web which covers the surface, and said tube being in an intitial position beneath the roll such that the central axis of the tube is spaced in said direction from the central axis of the roll, and said tube being in a normal position beneath the roll such that said central axes lie in a plane perpendicular to the web which covers the surface, whereby during a rolling up of the web said tube shifts by rolling on itself from said initial to said normal positions for causing said roll to slip to thereby tighten the web, whereafter said tube rolls on itself in said direction together with the roll and serves to maintain a tight web.

2. The system according to claim 1, wherein said core includes an outwardly extending axle, said means for rolling up the web comprising a gear motor operatively coupled to said axle for rotation of said core.

3. The system according to claim 1, wherein said means for rolling up the web comprises a plurality of first, spaced straps wrapped about the outer periphery of the roll in the same direction of roll-up, and means for reeling up said straps to affect a rolling up of the web and for steering the roll said straps lying between the web and said surface.

4. The system according to claim 2, wherein said means for rolling up the web further comprises a plurality of first, spaced straps wrapped about the outer periphery of the roll in the same direction of roll-up, and means for reeling up said straps to affect a rolling up of the web and for steering the roll said straps lying between the web and said surface.

5. The system according to claim 2, further comprising a guide arm journalled at one end on said axle, said surface having a guide groove located outwardly of web, and a guide roller at the other end of said arm for engaging said groove to guide the roll therealong.

6. A system for unrolling a web without bulging from a wound web roll for covering a surface with one end of the web anchored thereto, comprising, a core about which the web is rolled, said core including an outwardly extending axle, a plurality of spaced straps disposed between individual turns of said wound web roll in the same direction of web winding, means for unwinding said straps from their wrapped condition to effect an unrolling of the web from said wound web roll, a gear motor operatively coupled with said axle, and means for powering said motor, said powering means being disconnected during unrolling whereby said motor serves (to retard rotation of said axle against unrolling to thereby effect a tightening of the web during unrolling.

7. The system according to claim 6, further comprising a guide arm journalled at one end on said axle, said surface having a guide groove located outwardly of said web, and a guide roller at the other end of said arm for engaging said groove to guide the roll therealong.

8. The system according to claim 1, further comprising means for unrolling the web without bulging from the roll for covering the surface, comprising a plurality of spaced straps disposed between individual turns of said roll in the same direction of web winding, means for unwinding said straps from their wrapped condition to effect an unrolling of the web from the wound roll, a gear motor operatively coupled with said axle, and means for powering said motor, said powering means being disconnected during unrolling whereby said motor serves to retard rotation of said axle against unrolling to thereby effect a tightening of the web during unrolling.

9. The system according to claim 3, further comprising a guide arm journalled at one end on said axle, said surface having a guide groove located outwardly of said web, and a guide roller at the other end of said arm for engaging said groove to guide the roll therealong.

10. The system according to claim 8, wherein said means for rolling up the web comprises said gear motor with said powering means operatively connected thereto.

* * * * *